United States Patent [19]

Berrang

[11] Patent Number: 4,664,559

[45] Date of Patent: May 12, 1987

[54] REMOTELY OPERATED MAGNETIC RELEASE FOR ANCHORED AQUATIC INSTRUMENTATION

[75] Inventor: Peter G. Berrang, Victoria, Canada

[73] Assignee: Seastar Instruments Ltd., Sidney, Canada

[21] Appl. No.: 889,755

[22] Filed: Jul. 28, 1986

[51] Int. Cl.[4] ..... B63B 21/50

[52] U.S. Cl. ..... 405/224; 114/294; 367/133; 405/195; 441/2

[58] Field of Search ..... 405/190, 191, 172, 224, 405/195; 441/2; 114/293, 294; 367/133, 131

[56] References Cited

U.S. PATENT DOCUMENTS

| | | | |
|---|---|---|---|
| 3,130,703 | 4/1964 | Thompson | 114/294 |
| 3,287,753 | 11/1966 | Race | 441/2 |
| 3,287,781 | 11/1966 | Perez et al. | 114/294 X |
| 3,316,531 | 4/1967 | Baker | 367/133 X |
| 3,463,113 | 8/1969 | Feyling | 441/2 X |
| 3,602,959 | 9/1971 | Perez | 441/2 X |
| 3,727,417 | 4/1973 | Shaw | 405/171 |
| 3,858,166 | 12/1974 | Hammond | 367/133 |
| 3,987,741 | 10/1976 | Tryon | 405/191 X |
| 4,136,415 | 1/1979 | Blockburger | 441/2 |
| 4,498,814 | 2/1985 | Brake | 405/195 X |

*Primary Examiner*—Dennis L. Taylor

[57] ABSTRACT

A latch mechanism (release) for use in anchoring equipment and devices submerged in water, held closed by a permanent magnet and which can be automatically or remotely opened by diverting the magnetic field. The release is held closed by the magnetic attraction between a permanent magnet and a plate on a lever arm whose movement effects closure of the latch. A spring acts to move the lever arm and open the latch but the magnet normally overwhelms it. The latch opens when a brief electromagnetic field is applied to a soft magnetic alloy which guides magnetic flux from the magnet to the plate on the latch. The brief electromagnetic field weakens the attraction between the magnet and the plate by diverting the magnetic flux through an alternate loop in the alloy material, and thus allows the spring on the lever arm to open the latch. The release is triggered by acoustic signals transmitted to it and which are processed by an internal acoustic transducer and electronic controller which, upon receipt of appropriate acoustic signals, supplies electrical current to a coil surrounding the magnetic alloy material. The release mechanism has a low power requirement, is simple and yet is strong when closed.

7 Claims, 4 Drawing Figures

FIG. 1
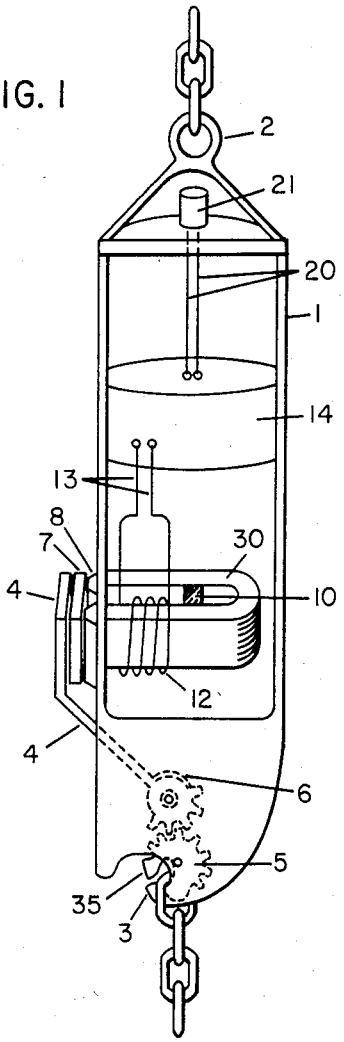
FIG. 2
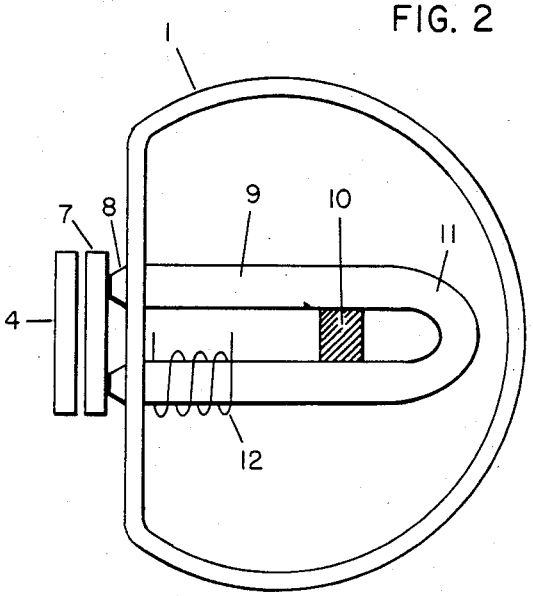
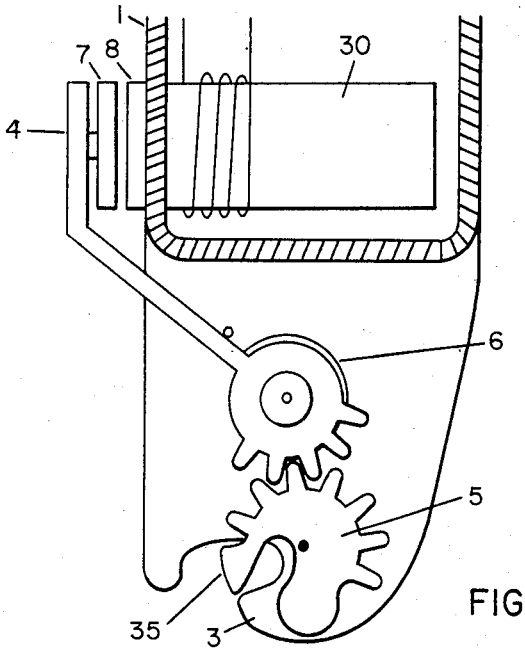
FIG. 3
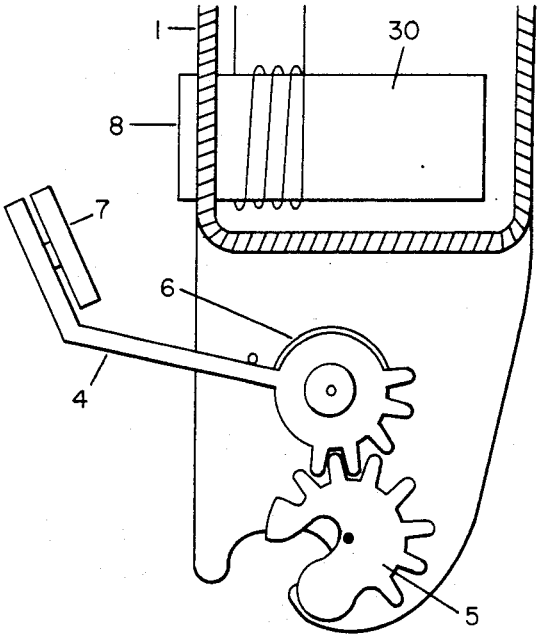
FIG. 4

REMOTELY OPERATED MAGNETIC RELEASE FOR ANCHORED AQUATIC INSTRUMENTATION

BACKGROUND OF THE INVENTION

The present invention relates to releases (latches) which are held closed by means of magnets and which open when the magnetic field is removed or altered, and more particularly to such a release capable of submergence in water and having a low electrical power requirement, and which when used in combination with a system for signalling the release to open, can release from anchorage instruments and equipment which must operate submerged in the ocean or in freshwater lakes and/or rivers.

Devices, instruments and equipment must frequently be anchored in the ocean or in freshwater at depths or in situations which make direct mechanical or electrical connection with the apparatus by operators, or manual tending of them difficult or impossible. Frequently it is desirable to recover these devices for re-use. A common technique for recovery has been to anchor them with a latch or lock mechanism which can automatically or remotely be triggered to release and use added buoyancy to float them to the water surface. A variety of mechanisms have been used for holding the latch firmly closed during anchorage and opening the latch when needed. These include devices which remove pins by the motion of worm gears and electrical solenoids; wires or links which corrode or dissolve in water and thereby open latches; and latches which open by means of explosives or pressurized gases.

The current invention is a latch mechanism which is held in a closed position by the force of magnetic attraction between a permanent magnet and a metal plate. The latch opens when the magnetic field holding the latch closed is weakened, through a technique which diverts the magnetic flux, and a spring overcomes the force of magnetic attraction and forces the latch open. In the invention, the permanent magnet is not in direct contact with the plate but rather its magnetic field is channelled to the plate through the combination of a piece of soft magnetic alloy material and a pair trapezoidal steel plates which focus the field. The soft magnetic alloy material that so channels the magnetic field to the plates, is U- or horseshoe-shaped, with the ends of the arms on the open part of the U corresponding to the location of the two focussing plates. The permanent magnet contacts the soft magnetic alloy U between and midway along the two arms of the U. When the plate from the latch mechanism makes contact with the trapezoidal metal pieces, the configuration of the magnetic latch components becomes a loop. This configuration encourages the establishment of a strong magnetic flux there.

A second magnetic circuit or loop contacting the permanent magnet also exists within the device. In this case it is formed by the combination of the closed part of the soft magnetic alloy U and the permanent magnet. The overall magnetic flux of the permanent magnet is balanced between the flux in each of the loops in the device. In the current invention the flux in the loop which holds the latch mechanism closed can be disrupted by subjecting that loop to an electromagnetic field created by directing an electric current through a wire coil placed around one of the arms of the soft magnetic alloy U. When this occurs most of the magnetic flux is diverted to the second soft magnetic alloy loop, and consequently weakens the flux in the main loop. The flux can be weakened to such an extent that a spring on a lever arm on which the metal plate on the mechanism is mounted, can pull the plate away from the metal focussing plates and open the latch. Control for the device comes from an electronic control sytem linked to an acoustic transducer. Upon detection of acoustic signals from a remote source, the controller turns on a flash circuit which briefly supplies an electrical current to the coil which surrounds one arm of the magnetic alloy U, thereby effecting the opening of the latch. A key feature of the device is that the magnetic field used to secure the latch mechanism in a closed position can pass through a pressure housing separating the magnet and soft magnetic alloy material from the trapezoidal metal focussing plates which contact the plate on the latch mechanism. This enables opening of the latch to be controlled without the need for mechanical components which pass through the pressure housing.

The objectives accomplished by this invention are: to provide a latch mechanism, for use submerged in the ocean or in freshwater, which remains tightly closed but can be opened automatically or remotely when used in combination with a system which controls the release by supplying an electrical current at the time of desired release; to provide a remote latch device which is simple, has few moving parts, low power consumption and is likely to be highly reliable; to provide an electronic means of opening a latch and therefore enabling precise control of the operation; to provide an automatic or remotely operating electronic catch mechanism which has no parts that penetrate into a pressure housing which separates the electronics from the water, and therefore requires no seals, removing all possibility of leakage.

DESCRIPTION OF THE DRAWINGS

FIG. 1 is a cross sectional side view of the preferred embodiment of the remotely operated release mechanism of the present invention.

FIG. 2 is a cross sectiional top view of the magnetic latch of the system in FIG. 1.

FIG. 3 is a side view detail of the magnetic latch of the system of FIG. 1 in closed configuration.

FIG. 4 is a side view detail of the magnetic latch of the system of FIG. 1 in open configuration.

DESCRIPTION OF THE PREFERRED EMBODIMENTS

FIGS. 1–4 are descriptions of the preferred embodiment of the invention. The invention consists of a metal housing 1 which protects internal operating components from pressure and leakage when the invention is submerged in water. Attached to the top of the housing is a bracket 2 to which instruments, devices and/or equipment requiring anchorage under water and whose later retrieval is required, may be attached. At the bottom of the housing is a hook 3 which enables attachment of the invention by a variety of means, including wires, shackles, chain or rope, to an anchorage. Mounted on the hook is a release mechanism consisting of a geared lever arm 4 mounted with its fulcrum on the hook, a geared eccentric wheel 5 mounted on the hook and one or several springs 6 which surround the fulcrum of the geared lever arm and exert a force which causes the lever arm to rotate when not secured. The geared lever arm 4 and geared eccentric wheel 5 are arranged and shaped in such a way that when the lever arm is in its full upright position, a tongue 35 on the eccentric wheel closes off the opening of the hook, enabling any object placed initially in the hook to be held firmly. Conversely, when the lever arm is fullest downward, the eccentric wheel closes off the hook from the inside of the curve out, leading to objects in the hook being forced out.

The geared lever arm is held in place in an upright position by the magnetic attraction between a metal plate 7, attached to the upper end of the lever arm, and a pair of trapezoidal metal pieces 8 mounted on the outside of the pressure housing. The trapezoidal metal pieces are located on the outside of the housing in proximity to the location where the two ends of a horseshoe shaped piece of a soft magnetic alloy material 30 meet the inside of the housing. The soft magnetic alloy material serves to channel the magnetic field from a permanent magnet 10, embedded between and midway along the arms of the magnetic alloy U, to the trapezoidal metal pieces. The attraction between the trapezoidal metal pieces and the metal plate on the geared lever arm, is sufficient to hold the lever arm in place against the force of the opposing spring 6.

The configuration of the closed end 11 of the soft magnetic alloy U and the embedded permanent magnet forms a loop. An electrically conducting coil 12 surrounds one of the arms 9 of the U-shaped piece of soft magnetic alloy material and is located between the permanent magnet and the open end of the U. Wire leads 13 from the coil are connected to a control system 14 which is capable of supplying electrical current to the coil. The control system in the preferred embodiment consists of batteries, a microprocessor/controller and support circuitry which is linked by wires 20 to an acoustic transducer 21, mounted either outside and on top of the housing or inside it and capable of transmitting and receiving acoustic pulses. The transducer is used for communication between the microprocessor and a transmitter/receiver unit remote to the device.

When acoustic signals are sent to the instrument instructing the release mechanism to operate or if the instrument is otherwise programmed to trigger the release mechanism, the instrument's microprocessor controller supplies a brief electrical current to the wire coil 12 that surrounds an arm 9 of the soft magnetic alloy material U near its open end. The electromagnetic field supplied by the coil weakens the magnetic flux in the loop consisting of the permanent magnet, the arms of the horseshoe shaped portion of the soft magnetic alloy material, the pressure housing, the trapezoidal metal focussing pieces and the metal plate on the lever arm, by temporarily diverting it to the loop consisting of the closed portion of soft magnetic material U 11 and the permanent magnet. The strength of the magnetic flux in the former loop is so weakened by the imposed magnetic field that the force of the spring on the lever arm is sufficient to pull the latch open. Rotation of the lever arm 4 under the influence of the spring causes the eccentric geared wheel 5 mounted on the hook shaped projection of the housing to rotate. The rotation moves the tongue shaped projection 35 on the eccentric wheel away from a position in which it closes the opening of the hook, and a portion of the wheel moves into the opening, forcing out objects used to anchor the device and held within the hook. With the latch open, the instrument and equipment or devices attached to it detach from the anchorage under the influence of buoyancy supplied to the system above the release point.

It will be appreciated that numerous modifications may be made in the present system in addition to the particular embodiment as will be apparent to those skilled in the art. For example the release mechanism may employ other means of force than a spring to serve to open the mechanism when the magnetic force is relaxed. These may include gravity, buoyancy, or force exerted by compressed gases in pistons. Further, if buoyancy is employed, the instrument may be anchored using only the magnetic attraction between the trapezoidal focussing plates and a metal anchor plate. In addition, the invention may be used with a variety of control mechanisms apart from the acoustic means described, including electronic timers, mechanical/electrical clock timers, direct electrical links such as electrical cables running to the instrument or direct mechanical connections such as on/off switches which may be operated manually by divers or through mechanical links with the surface. Also the system may be used with the magnetic alloy material in direct contact with the metal plate used to secure the release rather than through the instrument housing and via trapezoidal metal pieces as in the present embodiment. Further the housing may be made of plastic or ceramic instead of metal. The release mechanism may be contained in a package altogether unto itself or incorporated into an instrument used for other purposes.

Having thus described the invention, what we claim and desired to obtain by Letters Patent of the United States is:

1. A device that enables the remote or automatic opening of a latch submerged in water by relaxation or interruption of a magnetic field by means of an applied electromagnetic field, comprising:

a housing capable of resisting pressure and being watertight;

an acoustic transducer which can generate sound pulses from electrical signals and produce electrical signals from sound impinging on it;

a microprocessor/controller, power supply and electronic circuitry capable of decoding signals produced by the transducer in response to incoming sound pulses, of coding and sending electrical signals to a transducer and thereby generating coded sound signals via the transducer, and of supplying current to a coil surrounding a soft magnetic alloy material;

a permanent magnet embedded in a place of soft magnetic alloy material;

two or more trapezoidal metal bars on the outside of a pressure housing near the point of approach of arms of a U-shaped piece of soft magnetic alloy to the housing on the inside of the housing;

an electrical conducting coil which surrounds one or more arms of a horseshoe shaped portion of a soft magnetic alloy material;

a lever arm which has a fixed point of rotation on the housing, on one end of which is a metal plate which and whose other end is geared;

an eccentric gear wheel with a fixed point of rotation on the instrument housing and whose gears are enmeshed with gears on a lever arm and which upon turning and by its eccentricity can open and close an opening in a hook shaped projection of the instrument housing;

a spring which which exerts a rotational force on a lever arm that is opposite in direction to that imposed on the lever arm by the magnetic attraction of a permanent magnet to a metal plate on the arm.

2. The device of claim 1 wherein the magnetic alloy material and embedded permanent magnet is horseshoe or U-shaped, having a loop at one end and two projecting prongs at the other, and where the permanent magnet is embedded between the loop portion and open ends of the U.

3. The device of claim 1 wherein the ends of the horseshoe- or U-shaped portion of the soft magnetic alloy material are adjacent to the wall of a pressure housing.

4. The device of claim 1 wherein a conducting wire coil encircles one or more arms of a horseshoe- or U-shaped piece of soft magnetic alloy material connected with a permanent magnet and in which, if an electrical current is passed through the coil, a magnetic field is generated which acts to increase the magnetic reluctance of that arm.

5. The device of claim 1 wherein the magnetic reluctance of the loop formed from a permanent magnet, two arms of soft magnetic alloy material, instrument housing, trapezoidal metal bars and a metal plate on the lever arm, is lower than the magnetic reluctance of the loop comprising the permanent magnet and a loop of soft magnetic alloy material.

6. The device of claim 1 wherein the control mechanism which supplies an electrical current to the coil surrounding the horseshoe- or U-shaped portion of soft magnetic alloy material at a predetermined time or on command is a microprocessor/controller.

7. The device of claim 1 wherein acoustic transducer in conjunction with an electronic microprocessor/controller sends and receives signals for control of the instrument.

* * * * *